United States Patent [19]

Peterson

[11] Patent Number: 4,679,772

[45] Date of Patent: Jul. 14, 1987

[54] WIRE FENCE POST BRACING SYSTEM

[76] Inventor: Duane G. Peterson, Box #22, Dutton, Mont. 59433

[21] Appl. No.: 886,335

[22] Filed: Jul. 17, 1986

[51] Int. Cl.[4] ..... B21F 27/00

[52] U.S. Cl. ..... 256/36; 256/35

[58] Field of Search ..... 256/35, 36

[56] References Cited

U.S. PATENT DOCUMENTS

| | | | |
|---|---|---|---|
| 397,110 | 2/1889 | Cleaveland | 256/35 |
| 556,518 | 3/1896 | Phelps | 256/35 |
| 567,557 | 9/1896 | Whitehead | 256/35 |
| 579,918 | 3/1897 | Davis | 256/35 |
| 619,684 | 2/1899 | Emerton | 256/35 |
| 2,445,545 | 7/1948 | Verner | 256/35 |

FOREIGN PATENT DOCUMENTS

| | | | |
|---|---|---|---|
| 1939752 | 2/1970 | Fed. Rep. of Germany | 256/35 |

*Primary Examiner*—Andrew V. Kundrat

*Attorney, Agent, or Firm*—Harvey B. Jacobson

[57] ABSTRACT

A pair of brace anchors are carried by a pair of adjacent fence posts and include support members projecting outwardly from the brace anchors toward each other. A bracing fence rail is interposed between the post with the opposite ends of the rail and the support members telescopingly engaged with each other and two pairs of wire strands are anchored and extend between lower and upper end portions of the adjacent posts. An elongated lever is inserted between each pair of wire strands and angularly displaced about an axis extending along the corresponding pair of wire strands in order to twist the latter and thereby reduce the effective length thereof until the wire strands are tensioned, as desired.

5 Claims, 14 Drawing Figures

WIRE FENCE POST BRACING SYSTEM

BACKGROUND OF THE INVENTION

1. Field of the Invention

This invention relates to a system for bracing adjacent posts of a fence at a corner of a fence, at the intersection between two fence lines, at an abrupt change in inclination in a fence line and as mid-length bracing in a fence line. Fence bracing systems of similar types are classified in Class 256, Subclasses 32 and 35.

2. Description of Related Art

Examples of fence bracing system including some of the general structural and operational features of the instant invention are disclosed in U.S. Pat. Nos. 170,024, 282,039, 444,753, 966,969, 1,795,728, 3,014,701 and 3,655,167. However, these previously known forms of fence bracing systems do not include the combination of features of the instant invention wherein fence post bracing top rails may be secured between adjacent fence posts and variable tension diagonal bracing members may be secured between the same two posts.

SUMMARY OF THE INVENTION

The post bracing system of the instant invention has been designed to provide adequate bracing between adjacent supportive posts of a wire fence. Further, the post bracing system is constructed in a manner whereby inexpensive bracing may be provided between adjacent posts of a fence, wherever desired and needed. Further, the bracing system incorporates structural features which may be readily modified for adaption to different fencing systems.

The main object of this invention is to provide a fence post bracing system which may be readily incorporated in a wire fence system as it is erected.

Another object of this invention is to provide a fence post bracing system which may be added to existing fencing systems.

Still another important object of this invention is to provide a post bracing system which may be used in conjunction with fence posts of various configurations.

A further object of this invention is to provide a fence post bracing system which will enable the provision of variable tension diagonal bracing between adjacent fence posts.

A final object of this invention to be specifically enumerated herein is to provide a fence post bracing system in accordance with the preceding objects and which conform to conventional forms of manufacture, be of simple construction and easy to install so as to provide a device that will be economically feasible, long lasting and relatively trouble free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
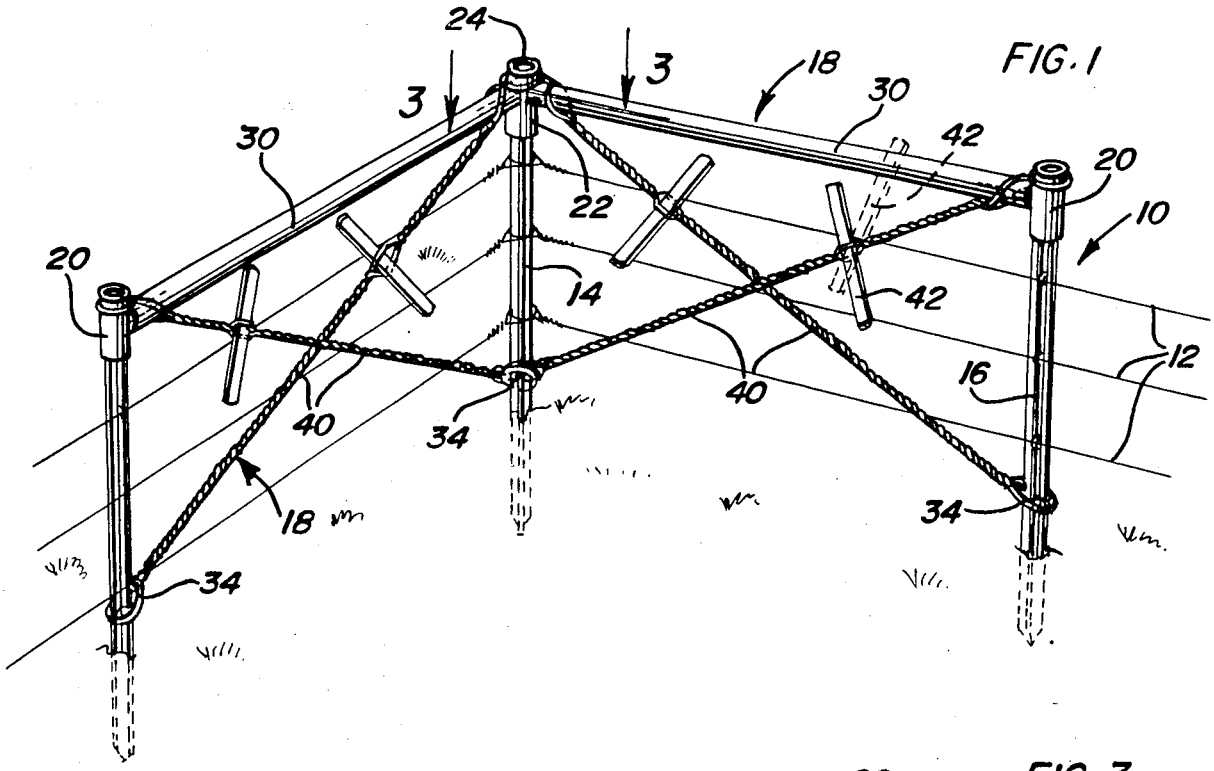
FIG. 1 is a fragmentary perspective view of a corner area of a wire fence with the corner post and two adjacent line posts braced relative to each other in accordance with the present invention.
Figure 2:
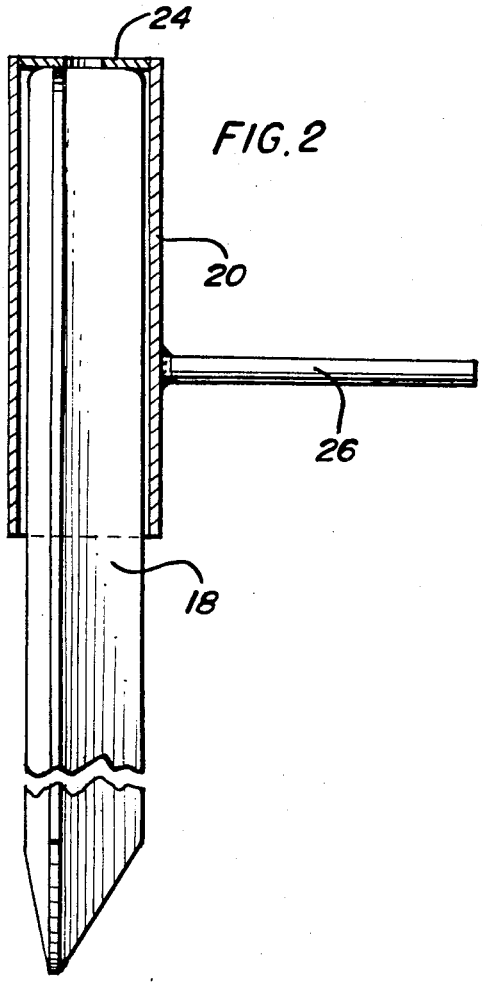
FIG. 2 is a fragmentary enlarged vertical sectional view illustrating the manner in which a brace anchor of the bracing system may be downwardly telescoped over the top of a fence post.
Figure 3:
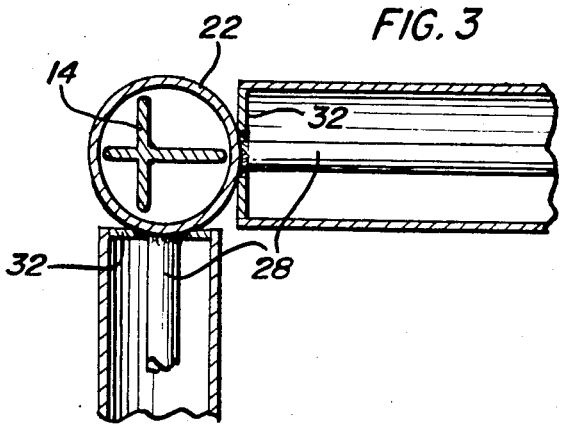
FIG. 3 is an enlarged fragmentary horizontal sectional view taken substantially upon the plane indicated by the section line 3—3 of FIG. 1.

Referring now more specifically to the drawings, the numeral 10 generally designates a wire fence incorporating a plurality of generally horizontal wire strands 12 extending between and supported from metal fence post including a corner post 14 and two adjacent line posts 16 and 18. The fence posts 14, 16 and 18 are cruciform in cross section and are of the type which may be driven into the ground and have the wire strands 12 anchored relative thereto.

The post bracing system of the instant invention is referred to in general by the reference numeral 18 and includes a pair of first brace anchors 20 supported from the upper ends of the posts 16 and 18 and a third brace anchor 22 supported from the upper end of the post 14. The brace anchors 20 comprise cylindrical bodies having centrally apertured discs 24 secured in the upper ends thereof and the tubular bodies 20 are downwardly telescoped over the fence posts 18 and 16 to a position with the underside of the discs 24 abutted against the upper ends of the posts 16 and 18. In addition, the brace anchors or tubular bodies 20 include horizontally outwardly projecting support members 26 projecting toward the post 14. The brace anchor 22 also comprises a tubular body having an apertured disc 24 secured in its upper end and the tubular body 22 includes a pair of right angularly disposed horizontally outwardly projecting support members 28.

A pair of top rails 30 extend between the tubular bodies 20 and the tubular body 22 and have their opposite ends telescoped over the support members 26 and the support members 28. In addition, the opposite ends of the top rails 30 have apertured discs 32 secured therein and the support members 26 and 28 are slidingly received through the discs 32.

Figure 13:
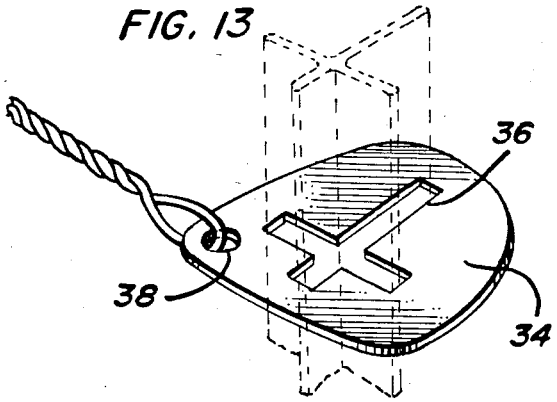
FIGS. 13 and 14 are perspective views of two forms of fence post tension member anchors.

The lower end portion of each post 16 and 18 includes a tension wire anchor member 34 disposed thereon, see FIGS. 1 and 13, and each anchor member 34 includes a first cruciform opening 36 formed therethrough in which the corresponding post 16 or 18 is slidingly received. In addition, each anchor member 34 includes a small diameter aperture 38 formed therethrough. Also, the lower end of the post 14 includes a pair of anchor members 34 guidingly mounted therefrom.

Figure 4:
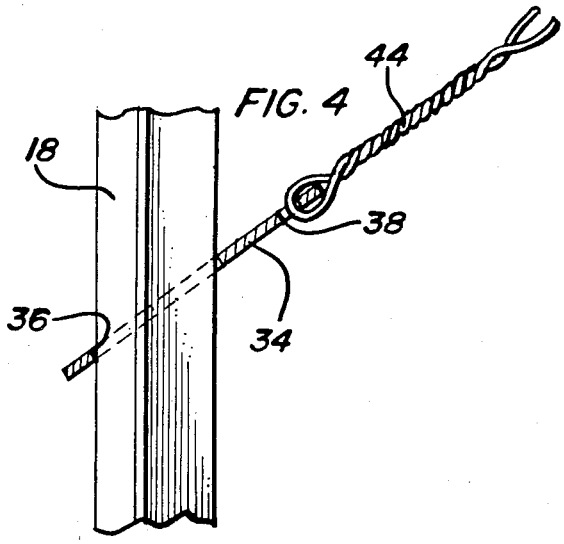
FIG. 4 is a fragmentary enlarged vertical sectional view illustrating the manner in which the lower end of one of the diagonal tension braces of the bracing system is anchored relative to a corresponding fence post.

Pairs of wire strands 40 extend between each anchor member 34 and the top end portion of the adjacent posts. The pairs of wire strands are looped about the upper ends of the next adjacent posts by being passed about the corresponding tubular body and thereafter looped about the adjacent end of the corresponding top rail 30. Longitudinal mid-portions of each pair of wire strands 40 have elongated lever 42 passed therebetween and the lever 42 is angularly displaced about an axis substantially paralleling and closely adjacent the wire strands 40 in order to twist the wire strands 40 in the manner illustrated in FIGS. 1, 4 and 13 of the drawings. The twisting of the wire strands 40 shortens the effective length thereof in order to tension the wire strands 40 between the upper and lower ends of adjacent posts. When the desired tension of the wire strands 40 has been achieved, the corresponding lever may be shifted slightly longitudinally so as to extend one end thereof for engagement with the corresponding top rail 30 in the manner illustrated in phantom lines in FIG. 1. This will retain the lever 42 against rotation and the wire strands 40 properly tensioned. Of course, if it is subsequently desired to further tension the wire strands 40, the lever 42 may be shifted longitudinally back to its original position and additionally angularly displaced so as to apply the proper tension on the corresponding wire strands 40. Then, the lever 42 may again be longitudinally displaced to extend one end thereof for engagement with the top rail 30 in order to retain the newly adjusted tension of the wire strands 40.

The anchor members 34 have the cruciform openings 36 formed therein enabling the anchor members 34 to slide along and be positioned as desired on the posts 14 and 16. However, as the wire strands 40 become tensioned, the anchor members 34 are inclined relative to a plane normal to the corresponding fence post in the manner illustrated in FIG. 4 of the drawings to cause the anchor member 34 to tightly frictionally engage the corresponding fence post and prevent sliding movement of the anchor member 34 along that fence post.

Although the fence corner bracing system illustrated in FIG. 1 utilizes crossed pairs of twisted wire strands 40 between each pair of adjacent posts, if it is desired only a single diagonal twisted wire tension structure may be used between each pair of adjacent posts.

Figure 7:
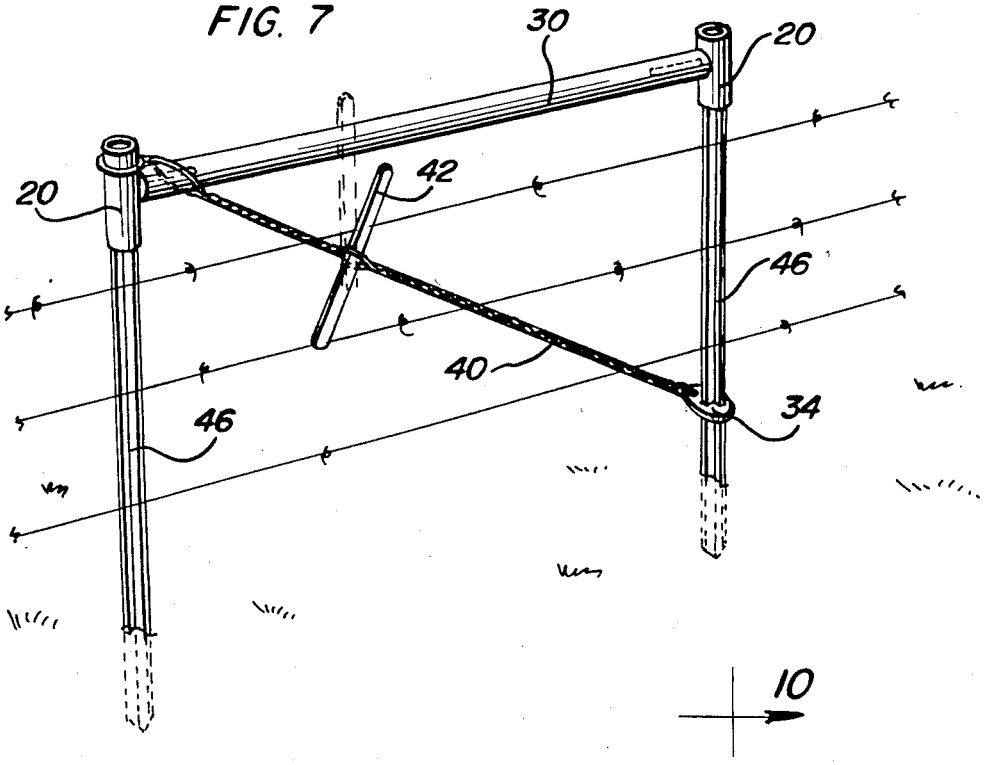
FIG. 7 is a fragmentary perspective view illustrating the manner in which a simplified form of bracing system may be incorporated in the midlength portion of a fence run.

With attention now invited more specifically to FIG. 7 of the drawings, it may be seen that a pair of brace anchors or tubular bodies 20 may be supported atop adjacent line posts 46 and that one of the line posts 46 may have an anchor member 34 supported therefrom. Further, a single top rail 30 may extend between the tubular bodies 20 and a single pair of twisted wire strands 40 may extend between the single anchor member 34 and the single tubular body 20, an elongated lever 42 being provided to enable adjustable tensioning of the wire strands 40. Therefore, two adjacent mid-line fence posts 46 may be adequately braced relative to each other in a simplied manner.

Figure 5:
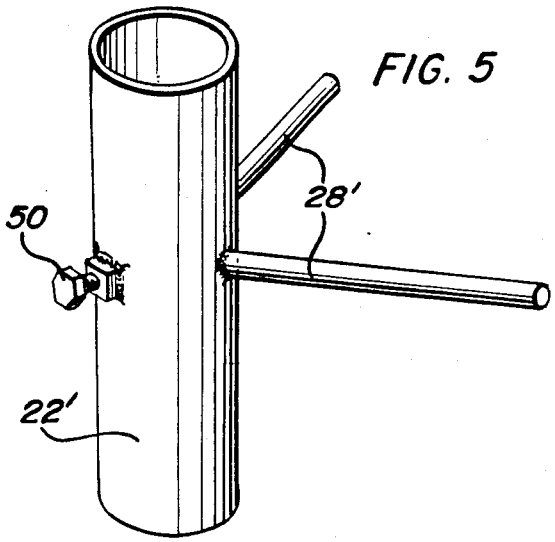
FIG. 5 is a perspective view of a brace anchor to be carried by a mid-height portion of a corner post.

With attention now invited more specifically to FIG. 5, there may be seen a modified form of brace anchor 22' and includes a pair of support members 28' corresponding to the support members 28. However, the brace anchor 22' is fully open at its upper end and therefore may be used upon a fence post in a position spaced below the upper end of that fence post, the brace anchor 22' including a threaded setscrew 50 supported therefrom by which the brace anchor 22' may be secured in position upon an associated fence post.

Figure 8:
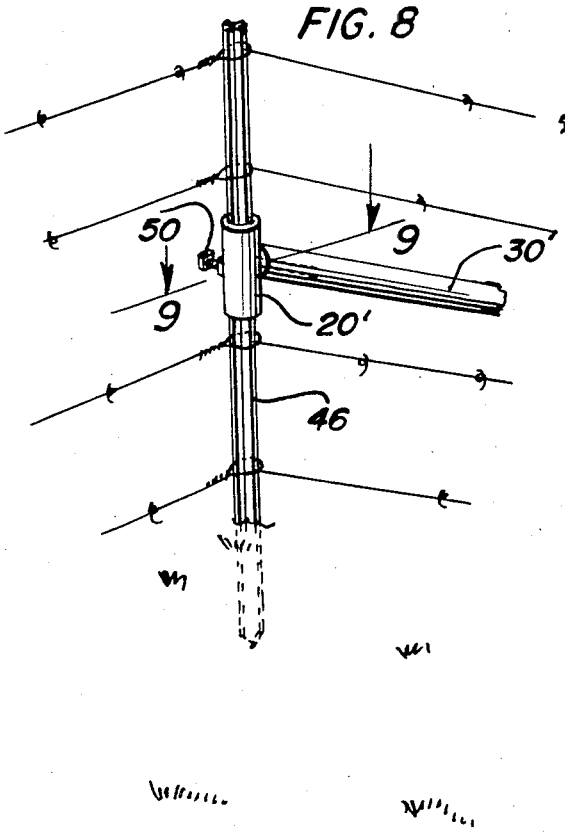
FIG. 8 is a fragmentary perspective view illustrating the manner in which a further simplified form of the brace anchor may be used for supporting a generally horizontal bracing rail between adjacent relatively inclined fence sections.
Figure 9:
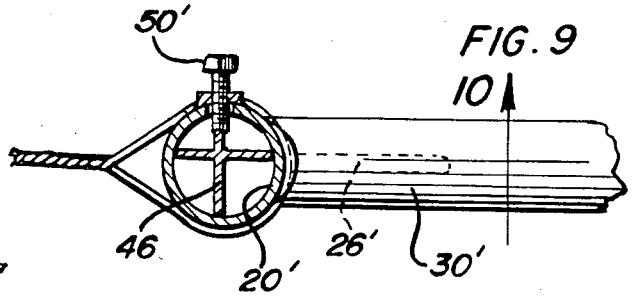
FIG. 9 is a fragmentary enlarged horizontal sectional view taken substantially upon the plane indicated by the sectional line 9—9 of FIG. 8.
Figure 10:
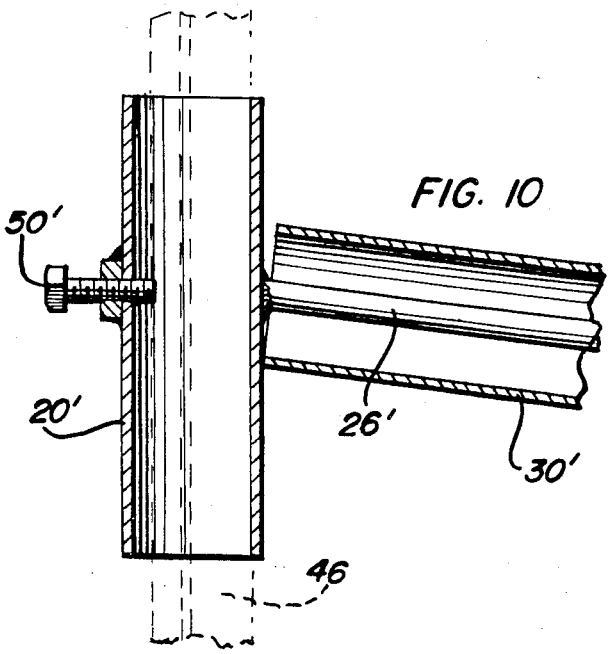
FIG. 10 is a fragmentary enlarged vertical sectional view taken substantially upon the plane indicated by the section line 10—10 of FIG. 9.

With attention now invited more specifically to FIGS. 8, 9 and 10, a further modified form of brace anchor is referred to by the reference numeral 20'. The brace anchor 20' includes a downwardly and outwardly angled support member 26' and a threaded setscrew 50' corresponding to the setscrew 50. Further, the upper end of the tubular body comprising the brace anchor 20 is fully open and therefore does not include a centrally apertured disc corresponding to the disc 24.

The brace anchor 22' therefore may be mounted upon an inline fence post 46 between adjacent fence sections of different inclination. Of course, the brace anchor 20' is used in pairs and a fence rail 30' corresponding to the rail 30 is used between a pair of adjacent brace anchors 20'. By utilizing a pair of brace anchors 20' and a rail 30', adequate bracing between adjacent line post 46 may be provided at an intersection between fence sections of different inclination.

Figure 14:
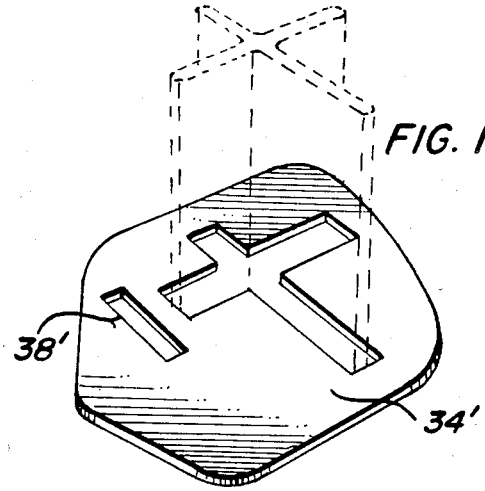
Figure 6:
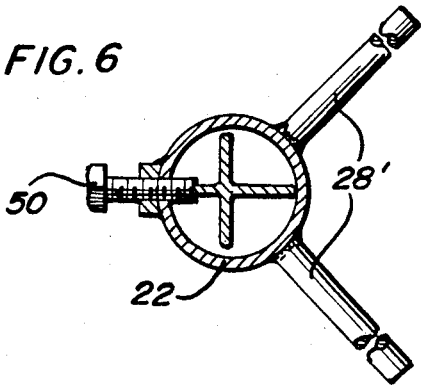
FIG. 6 is a horizontal sectional view illustrating the manner in which the brace anchor of FIG. 5 may be supported from a metal fence post.

With reference now more specifically to FIG. 14 of the drawings, a modified form of anchor member 34' is illustrated. The anchor member 34' is similar to the anchor member 34, but includes an elongated opening 38' formed therethrough rather than the aperture 38 provided in the anchor member 34.

Figure 11:
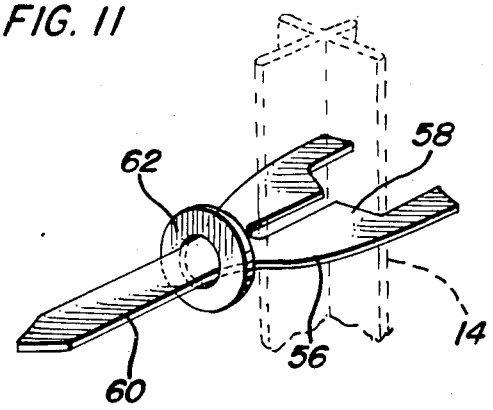
FIGS. 11 and 12 are perspective views of modified forms of brace anchors.
Figure 12:
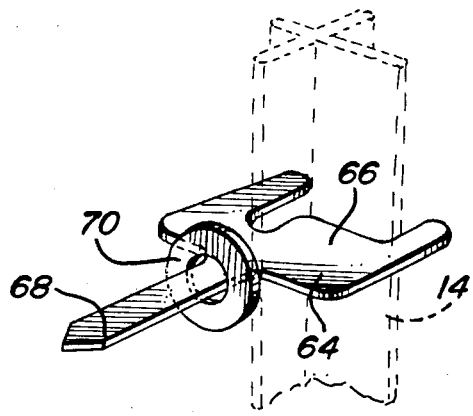

With attention now invited more specifically to FIG. 11, a brace anchor referred to by reference numeral 56 is illustrated. The brace anchor 56 is in the form of an elongated plate including a shaped notch 58 opening endwise outwardly of one end thereof and adapted to embracingly receive a metal fence post 14 or the like therein. The other end of the brace anchor 56 defines a sharpened shank portion 60 and the mid-length portion of the brace anchor 56 includes a centrally apertured abutment washer 62 mounted thereon. The brace anchor 56 may be used in conjunction with wooden top rails and brace rails with the shank portions 60 projecting into the ends of such wooden rails and the washers 62 abutted against the end faces of those wooden rails. Also, a brace assembly 64 of similar construction is illustrated in FIG. 12 including a somewhat differently shaped notch 66 formed in one end for embracing engagement with a metal fence post 14. Otherwise, the brace anchor 64 is similar to the brace anchor 56 in that includes a shank portion 68 corresponding to the shank portion 60 and equipped with an abutment washer 70 for abutting engagement with the end face of a corresponding wooden bracing rail.

The anchor members 34 and 34' are designed for use during installation of the fence construction 10. However, if the post bracing structure is to be added to an existing fence construction, the posts 16 and 18 may be sufficiently deflected at their upper ends in order to enable installation of the top rails 30 and the anchor members 34 may be strengthened and modified to include laterally opening notches (not shown) sufficient to enable the anchor members 34 to be laterally engaged with the posts 16 and 18, thereby eliminating the necessity of releasing the wire strands 12 from supported engagement from the posts 16 and 18.

Although it is believed apparent as to the manner in which the fence corner structure of FIG. 1 may be erected, the post 14 may first be driven into the ground and the top rails 30 may then be laid out at the desired angle to determine the positions of the posts 16 and 18. Then, the posts 16 and 18 may be driven into the ground and the anchor members 34 may be engaged with the posts 14, 16 and 18 adjacent ground level. Thereafter, the brace anchors 20 and 22 may be engaged with the top rails 30 and the brace anchors may be telescoped downwardly over the posts 14, 16 and 18. The wire strands 40 may then be strung and secured between the brace anchors 20 and 22 and anchor members 34 after which the levers 42 may be engaged with the wire strands 40 and angularly displaced in order to twist each pair of wire strands so as to adjust the tension thereof.

If it is desired to utilized wooden top rails or bracing rails, the ends of such wooden rails may be bored to receive the shank portions 60 and 68 of the corresponding brace anchors 56 and 64.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a fence including first and second adjacent fence posts having upper and lower end portions, a fence bracing system including first and second brace anchors removably supported from the upper end portions of said first and second posts, respectively, and including fence rail support members projecting toward each other, a rigid fence rail having opposite ends, said opposite ends and support members being telescopingly engaged for support of said fence rail ends from said support members, a tension wire anchor member engaged with the lower end portion of each of said posts, two pairs of at least two-strand sections of wire, each pair of wire strand sections having a first pair of corresponding end portions anchored relative to a corresponding anchor member and a second pair of end portions anchored relative to the upper end portion of the other post, a pair of elongated lever members each passing between the longitudinal mid-portions of a corresponding pair of wire strand sections and manually displaceable about an axis extending along said corresponding pair of wire strand sections and disposed transverse to the lever for twisting said corresponding pair of wire strand sections about each other and thereby adjustably shortening the effective length thereof to form an inclined tensioned connection between upper and lower end portions of said posts and with said pairs of twisted wire strand sections crossed and oppositely inclined relative to each other, said brace anchors each comprising an upstanding tubular member including an at least partially closed upper end, said tubular members each being downwardly telescoped over and abutted against the upper end portion of the corresponding post, those pairs of strand section end portions anchored relative to the upper end portions of said posts each being anchored thereto by being passed about the corresponding tubular body above the corresponding fence rail end and also being looped over said corresponding fence rail end.

2. The fence of claim 1 wherein said fence rail support members comprise shank portions projecting outwardly from said sleeves toward each other and said fence rail includes means defining opposite and outwardly opening recesses in which said shank portions are telescopingly received.

3. The fence of claim 1 wherein said anchor members include means defining openings therein for receiving said posts therethrough with the planes of said openings inclined relative to planes normal to said posts and portions of said anchor members defining opposite sides of said openings tightly frictionally engaged with opposing portions of said posts.

4. The fence of claim 3 wherein said openings include fully closed peripheries.

5. The fence of claim 1 wherein said fence includes a third post spaced from a side of said first post remote from said second post, said third post including a third brace anchor equipped with a third support member, a second rail extending between and having its opposite ends telescopingly engaged with said first and third support members, said one post comprising said second post, an additional wire anchor member engaged with a lower end portion of said third post, and two additional wire strands extending and anchored between said first support member and said additional wire anchor member and having a third lever member inserted between the mid-portions of said additional wire strands and angularly displaced about an axis transverse to said second lever and extending along said additional wire strands in order to twist the latter.

* * * * *